US009534428B2

(12) United States Patent
Kim et al.

(10) Patent No.: US 9,534,428 B2
(45) Date of Patent: Jan. 3, 2017

(54) HOOD LATCH HAVING DUAL UNLOCKING FUNCTION

(71) Applicant: PyeongHwa Automotive, Daegu (KR)

(72) Inventors: Sung Han Kim, Daegu (KR); Hyeon Tae Park, Yeongcheon-si (KR)

(73) Assignee: PYEONGHWA AUTOMOTIVE, Daegu (KR)

( * ) Notice: Subject to any disclaimer, the term of this patent is extended or adjusted under 35 U.S.C. 154(b) by 177 days.

(21) Appl. No.: 14/167,063

(22) Filed: Jan. 29, 2014

(65) Prior Publication Data

US 2014/0246870 A1 Sep. 4, 2014

(51) Int. Cl.
*E05C 3/16* (2006.01)
*E05B 83/24* (2014.01)

(52) U.S. Cl.
CPC ..... *E05B 83/24* (2013.01); *Y10T 292/1047* (2015.04)

(58) Field of Classification Search
CPC ..... E05B 83/24; B62D 25/10; B62D 25/105; Y10S 292/42; Y10S 292/14; Y10S 292/23; Y10T 292/1047
USPC ..... 292/216, DIG. 14; 296/193.11
See application file for complete search history.

(56) References Cited

U.S. PATENT DOCUMENTS 3,695,659 A * 10/1972 Gionet ..... E05B 83/16 292/210
4,815,775 A * 3/1989 Mertin ..... E05B 81/20 292/201
4,886,307 A * 12/1989 Ruckert ..... E05B 17/0025 292/201
5,411,302 A * 5/1995 Shimada ..... E05B 81/14 292/201
5,603,539 A * 2/1997 Gruhn ..... E05B 85/243 292/199
5,738,393 A * 4/1998 Chao ..... E05B 83/24 292/216
5,802,894 A * 9/1998 Jahrsetz ..... E05B 77/48 292/144
5,868,444 A * 2/1999 Brackmann ..... E05B 81/20 292/196

(Continued)

FOREIGN PATENT DOCUMENTS

CA WO 2013082711 A1 * 6/2013 ..... B62D 25/10
CA WO 2013127002 A1 * 9/2013 ..... E05B 83/24

(Continued)

*Primary Examiner* — Kristina Fulton
*Assistant Examiner* — Christine M Mills
(74) *Attorney, Agent, or Firm* — Hauptman Ham, LLP

(57) ABSTRACT

A hood latch includes a base coupled to a frame or a panel of a vehicle, a fork having a first fork protrusion, a second fork protrusion and a third fork protrusion and is coupled to the base to fix a striker positioned on a vehicle hood, a trigger which has a first trigger protrusion, a second trigger protrusion, and a third trigger protrusion, the first trigger protrusion is configured to contact the second fork protrusion or the third fork protrusion, thus controlling a rotation of the fork, a trigger connecting link configured to contact the trigger to rotate the trigger, and a trigger varying link coupled to a first side of the trigger connecting link. A rotating angle of the trigger is based on a contact between the trigger connecting link and a third trigger protrusion or a contact between the trigger varying link and the second trigger protrusion.

12 Claims, 7 Drawing Sheets

(56) References Cited

U.S. PATENT DOCUMENTS 5,934,717 A * 8/1999 Wirths ..... E05B 81/14 292/201
6,378,920 B1 * 4/2002 Ostrowski ..... E05B 83/16 292/216
6,419,286 B1 * 7/2002 Szablewski ..... E05B 77/24 292/201
6,485,071 B2 * 11/2002 Schwaiger ..... E05B 83/16 292/216
6,695,360 B1 * 2/2004 Forsell ..... E05B 83/16 292/201
7,243,973 B2 * 7/2007 Plett ..... B62D 33/0273 296/57.1
7,380,844 B2 * 6/2008 Berghahn ..... E05B 81/20 292/201
7,537,249 B2 * 5/2009 Ichinose ..... E05B 81/14 292/201
2005/0035604 A1 * 2/2005 Coleman ..... E05B 81/14 292/216
2005/0082842 A1 * 4/2005 Warmke ..... E05B 77/28 292/216
2005/0212302 A1 * 9/2005 Fisher ..... E05B 81/14 292/216
2008/0224482 A1 * 9/2008 Cumbo ..... E05B 77/02 292/216
2009/0322104 A1 * 12/2009 Nam ..... E05B 85/243 292/216
2010/0052341 A1 * 3/2010 Taurasi ..... E05B 81/14 292/304
2010/0127512 A1 * 5/2010 Vazquez ..... E05B 85/26 292/216
2010/0244466 A1 * 9/2010 Tomaszewski ..... E05B 77/26 292/201
2014/0062098 A1 * 3/2014 Kim ..... E05B 83/24 292/28

FOREIGN PATENT DOCUMENTS

DE 10022824 A1 * 10/2001 ..... E05B 83/16
KR 10-2014-0120679 A 10/2014

* cited by examiner

HOOD LATCH HAVING DUAL UNLOCKING FUNCTION

BACKGROUND OF THE INVENTION

1. Field of the Invention

The present invention relates to hood latches. More particularly, the present invention relates to a hood latch, which is intended to open a vehicle hood only in response to a user's manipulation in the interior of a vehicle.

2. Description of the Related Art

According to regulations (land ministry ordinance No. 229) pertaining to automobile safety standards, it is provided that a vehicle hood should employ a secondary locking structure or two locking structures. In order to satisfy such regulations, a hood latch that is used currently is primarily unlocked by primarily manipulating a lever in a vehicle, and then is secondarily unlocked by a secondary manipulation of a user after he or she gets out of the vehicle. Hence, this is problematic in that a user must move to get out of and get into the vehicle so as to open the hood, thus causing an inconvenience. Particularly in the case of a vehicle wherein the hood is equipped with a gas cylinder allowing it to be automatically opened, it is impossible for a user to automatically open the hood with a single manipulation, thereby causing annoyance to the user.

CITATION LIST

Patent Literature (Patent Literature 1) Korean Patent Laid-Open Publication No. 1998-045687

SUMMARY OF THE INVENTION

Accordingly, the present invention has been made keeping in mind the above problems occurring in the related art, and an object of the present invention is to provide a hood latch having a dual unlocking function, which enables a hood to be opened only in response to a manipulation in the interior of a vehicle, without requiring any manipulation at the exterior of the vehicle.

The present invention is not limited to the above-mentioned object, and those skilled in the art can clearly understand other objects that are not mentioned, based on the following description.

In order to accomplish the above object, the present invention provides a hood latch having a dual unlocking function, including a base coupled to a frame or panel of a vehicle; a fork including a first fork protrusion, a second fork protrusion and a third fork protrusion, and rotatably coupled to the base to fix a striker disposed on a vehicle hood; a trigger including a first trigger protrusion that comes into contact with the second fork protrusion or the third fork protrusion of the fork, thus controlling a rotation of the fork; and a trigger connecting link coming into contact with the trigger to rotate the trigger, wherein the trigger connecting link varies a rotating angle of the trigger.

Preferably, in the hood latch having the dual unlocking function according to the present invention, a trigger varying link may be rotatably coupled to the trigger connecting link, and the trigger may further include a second trigger protrusion and a third trigger protrusion, so that, as the trigger connecting link rotates, the second trigger protrusion may come into contact with the trigger connecting link, or the third trigger protrusion may come into contact with the trigger connecting link, depending on a position of the trigger connecting link, thus varying the rotating angle of the trigger.

Preferably, in the hood latch having the dual unlocking function according to the present invention, the base may include on a first side thereof a fork rotating shaft, and on a second side thereof a trigger rotating shaft, and the first fork protrusion, the second fork protrusion and the third fork protrusion may be sequentially formed about the fork rotating shaft, and the first trigger protrusion, the second trigger protrusion and the third trigger protrusion may be sequentially formed about the trigger rotating shaft.

Preferably, in the hood latch having the dual unlocking function according to the present invention, the trigger varying link may be rotatably coupled to an end of the trigger connecting link, and a connecting link extension may be formed on another end of the trigger connecting link, and the second trigger protrusion and the third trigger protrusion may include a first contact projection and a second contact projection, so that, when the trigger connecting link rotates counterclockwise, the connecting link extension may come into contact with the second contact projection to rotate the trigger counterclockwise, and the second fork protrusion may movably come into contact with the first trigger protrusion to rotate the fork counterclockwise, thus primarily unlocking the striker, when the trigger extension link rotates clockwise, the trigger varying link may come into contact with a first side of the first contact projection to rotate counterclockwise, and when the trigger extension link rotates counterclockwise again, the trigger varying link may come into contact with a second side of the first contact projection to rotate the trigger counterclockwise, so that the third fork protrusion may movably come into contact with the first trigger protrusion and thereby may rotate the fork counterclockwise, thus secondarily unlocking the striker.

Preferably, in the hood latch having the dual unlocking function according to the present invention, the first side of the trigger varying link may be formed in an arc shape.

Preferably, in the hood latch having the dual unlocking function according to the present invention, a trigger contact piece may be disposed on a first end of the trigger connecting link, and the trigger varying link may include on a first end thereof a varying-link contact piece that comes into contact with the trigger contact piece to restrict a rotation of the trigger varying link, and the trigger varying link may include a varying-link spring that rotates the trigger varying link clockwise, as long as no external force is exerted on the trigger varying link.

Preferably, in the hood latch having the dual unlocking function according to the present invention, the fork may include a fork spring to rotate the fork counterclockwise, as long as no external force is exerted on the fork, the trigger may include a trigger spring to rotate the trigger clockwise, as long as no external force is exerted on the trigger, and the trigger connecting link may be rotatably coupled to the base, with a trigger spring disposed on the trigger connecting link so that the trigger connecting link rotates counterclockwise as long as no external force is exerted on the trigger connecting link.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF PREFERRED EMBODIMENTS

Hereinafter, a hood latch having a dual unlocking function according to an embodiment of the present invention will be described in detail with reference to the accompanying drawings.

Figure 1:
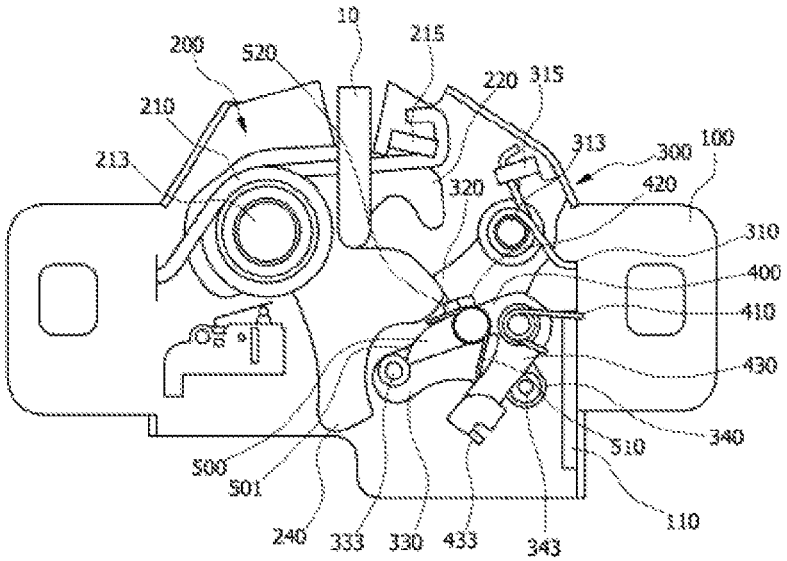
FIG. 1 is a plan view showing important parts of a hood latch having a dual unlocking function, according to an embodiment of the present invention.

As shown in FIG. 1, which is the plan view showing the important parts, a hood latch having a dual unlocking function according to the present invention includes a base 100 that is coupled to a frame or panel of a vehicle, a fork 200 that is rotatably coupled to the base 100 to fix a striker 10 disposed on a vehicle hood, a trigger 300 that controls the rotation of the fork 200, and a trigger connecting link 400 that rotates the trigger 300.

Referring to FIG. 1, the fork 200 functions to fix the striker 10. Above the left side of the base 100 is formed a fork rotating shaft 213 through which the fork 200 is rotatably coupled to the base 100, with the fork 200 being coupled to the fork rotating shaft 213.

As shown in FIG. 1, the fork 200 includes a first fork protrusion 220, a second fork protrusion 230 and a third fork protrusion 240, which are arranged about the fork rotating shaft 213 sequentially in a clockwise direction. The striker 10 is configured to be inserted between the first fork protrusion 220 and the second fork protrusion 230.

An elastic member 210 is disposed on such a fork 200 to allow the fork 200 to rotate counterclockwise about the fork rotating shaft 213 as long as no external force is exerted on the fork 200. Thus, as shown in FIGS. 3A to 3E, which are operational views showing the sequence of locking the striker of the hood latch having the dual unlocking function, when the striker 10 moves downwards, the fork 200 is rotated clockwise.

The trigger 300 serves to control the rotation of the fork 200 to which the elastic member 210 is coupled. As shown in FIG. 1, above the right side of the base 100 is disposed a trigger rotating shaft 313. The trigger 300 is rotatably coupled to the trigger rotating shaft 313. Similarly to the fork 200, an elastic member 310 is coupled to the trigger 300. The elastic member 310 is coupled to allow the trigger 300 to rotate about the trigger rotating shaft 310 clockwise, as long as no external force is exerted on the trigger 300.

Figure 2A:
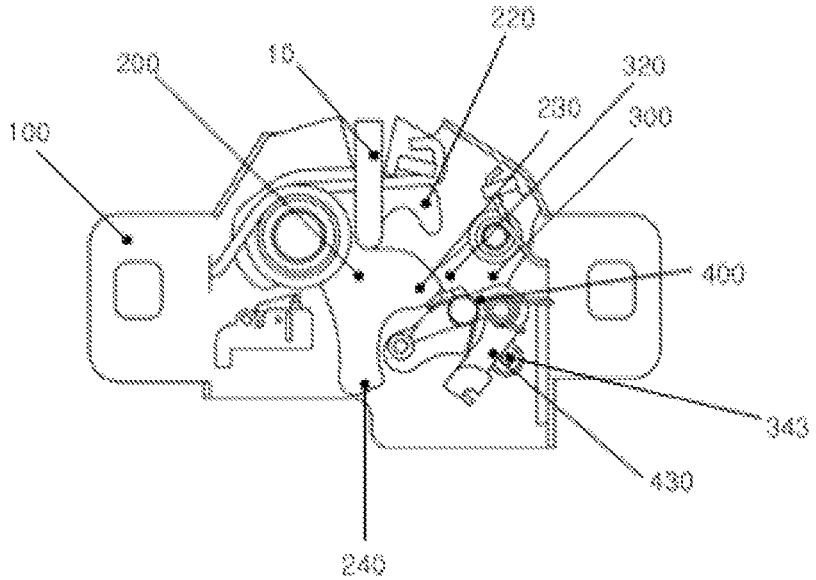
FIGS. 2A to 2H are operational views showing the sequence of unlocking a striker of the hood latch having the dual unlocking function shown in FIG. 1.
Figure 2B:
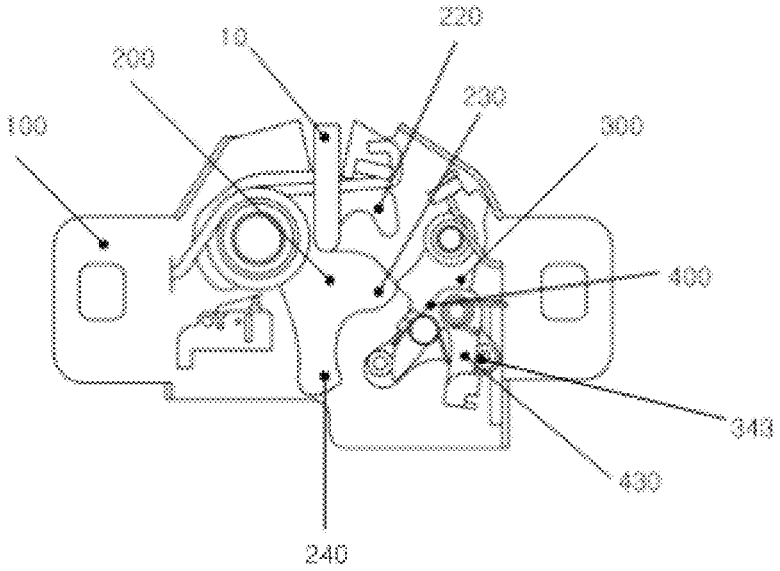
Figure 2C:
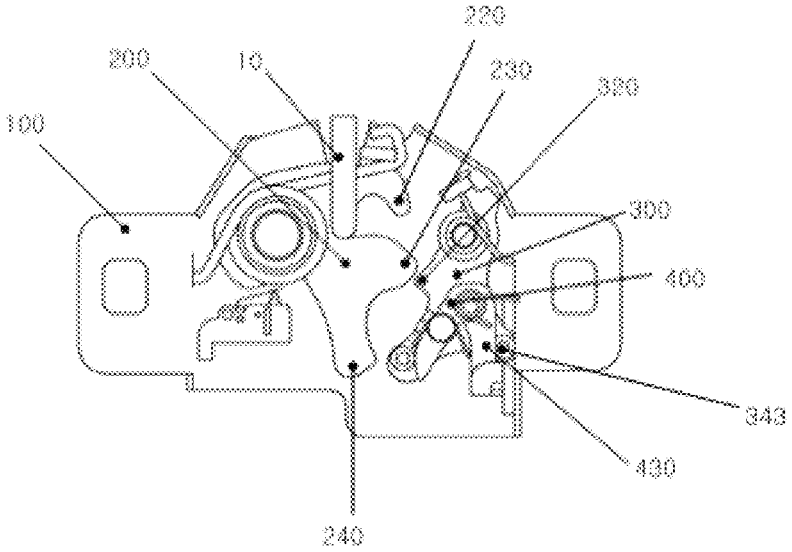

The rotation control of the fork 200 by the trigger 300 is carried out depending on a position of the fork protrusion that comes into contact with the first trigger protrusion 320 of the trigger 300. As shown in FIG. 2A, in the state where the first trigger protrusion 320 of the trigger 300 comes into contact with a side of an upper surface of the second fork protrusion 230, the fork 200 engages with the trigger 300, so that the fork 200 is not rotated. In this state, referring to FIGS. 2C and 2D wherein the trigger 300 is rotated about the trigger rotating shaft 310 counterclockwise, the second fork protrusion 220 of the fork 200 is rotated counterclockwise along the surface of the first trigger protrusion 320 of the trigger 300 until the third fork protrusion 240 of the fork 200 comes into contact with the first trigger protrusion 320, so that the striker 10 is primarily unlocked (see, FIG. 2D).

In this state, if the trigger 300 rotates counterclockwise as shown in FIGS. 2E to 2H, the third fork protrusion 230 of the fork 200 moves along the first trigger protrusion 320 of the trigger 300, thus rotating the fork 200 counterclockwise and thereby secondarily unlocking the striker 10.

As shown in FIG. 1, a trigger connecting link 400 is disposed under the left side of the base 100 to rotate the trigger 300. Thus, depending on an angle at which the trigger connecting link 400 rotates the trigger 300, the fork 200 is rotated as shown in FIGS. 2A to 2H as described above.

In the hood latch having the dual unlocking function according to the present invention, as shown in FIG. 1, a trigger varying link 500 is rotatably coupled to the trigger connecting link 400, and the trigger 300 further comprises a second trigger protrusion 330 and a third trigger protrusion 340. Thereby, depending on the position of the trigger 300, the second trigger protrusion 330 comes into contact with the trigger connecting link 400, or the third trigger protrusion 340 comes into contact with the trigger connecting link 400, thus varying the rotating angle of the trigger 300.

As shown in FIG. 1, the second trigger protrusion 330 of the trigger 300 is formed in the counterclockwise direction of the first trigger protrusion 320 about the trigger rotating shaft 313, and the third trigger protrusion 340 is formed in the counterclockwise direction of the second trigger protrusion 330. Thus, depending on whether the trigger connecting link 400 or the trigger varying link 500 rotatably comes into contact with the second trigger protrusion 330 or the third trigger protrusion 340, the rotating angle of the trigger 300 is varied, and depending on the rotating angle of the trigger 300, the rotating angle of the fork 200 is varied.

Referring to FIG. 1, in the hood latch having the dual unlocking function according to the present invention, a connecting link extension 430 may be formed on another side of the trigger connecting link 400, and the trigger connecting link 400 having the connecting link extension 430 is formed to entirely have the shape of '∧' or '∩'. Here, the connecting link extension 430 is disposed between the second trigger protrusion 330 and the third trigger protrusion 340, and a first contact projection 333 and a second contact projection 343 are formed on the second trigger protrusion 330 and the third trigger protrusion 340, respectively.

Figure 2D:
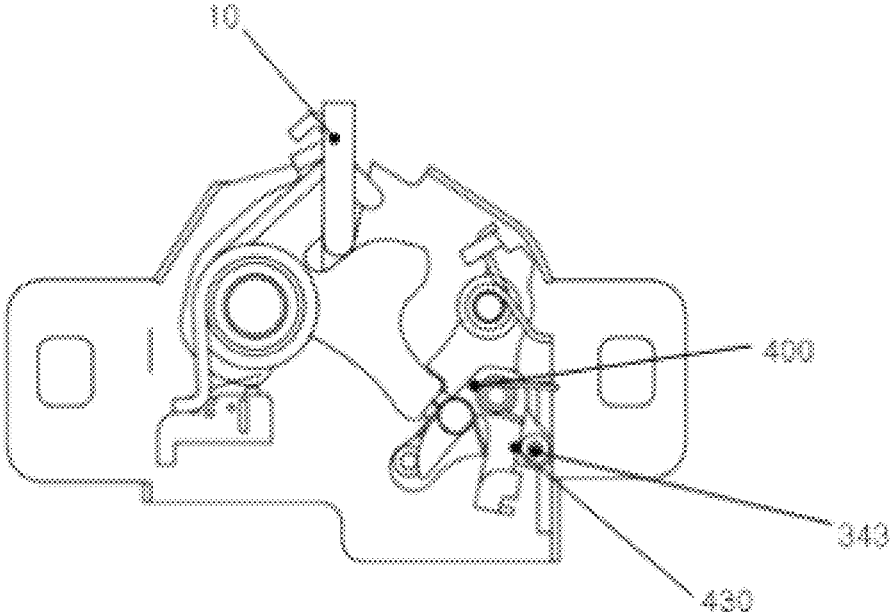

Thus, in the state where the striker 10 shown in FIG. 2A is coupled to the fork 200, if the trigger connecting link 400 rotates counterclockwise, the connecting link extension 430 comes into contact with the second contact projection 343, thus rotating the trigger 300 counterclockwise, and thereby rotating the fork 200 counterclockwise as shown in FIG. 2D. Consequently, the striker 10 is primarily unlocked.

Figure 2E:
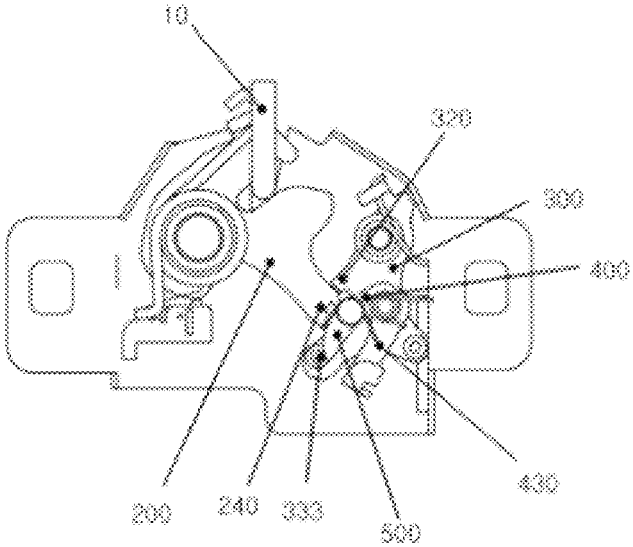
Figure 2F:
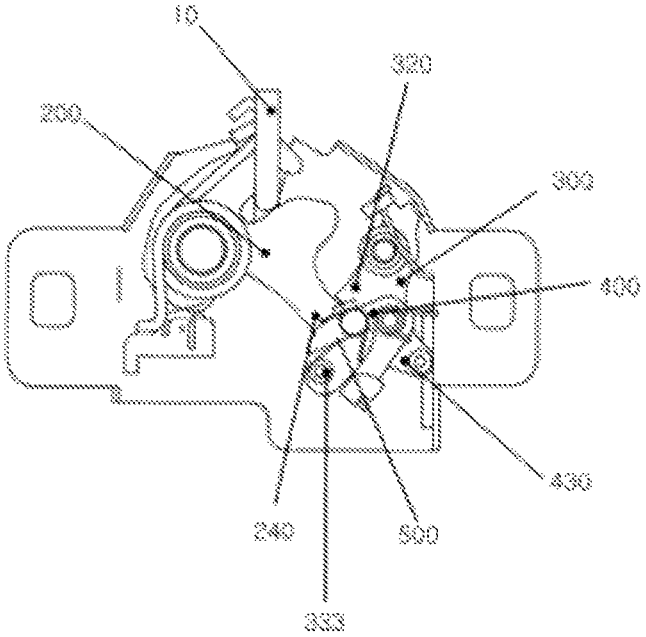
Figure 2G:
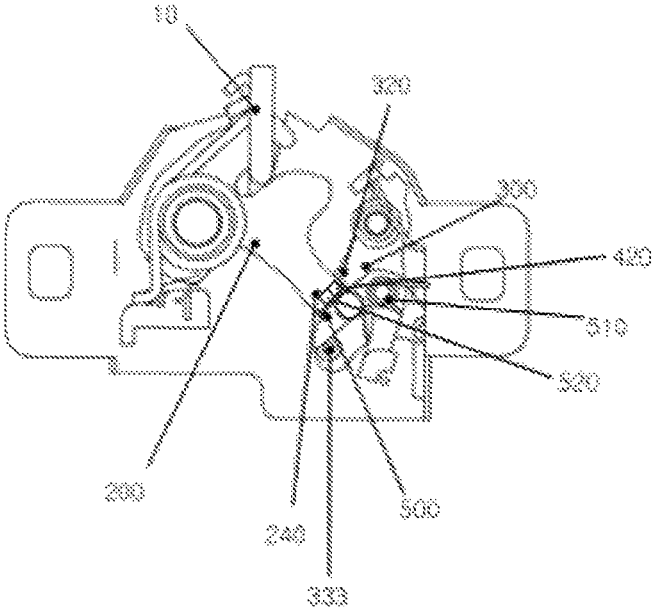
Figure 2H:
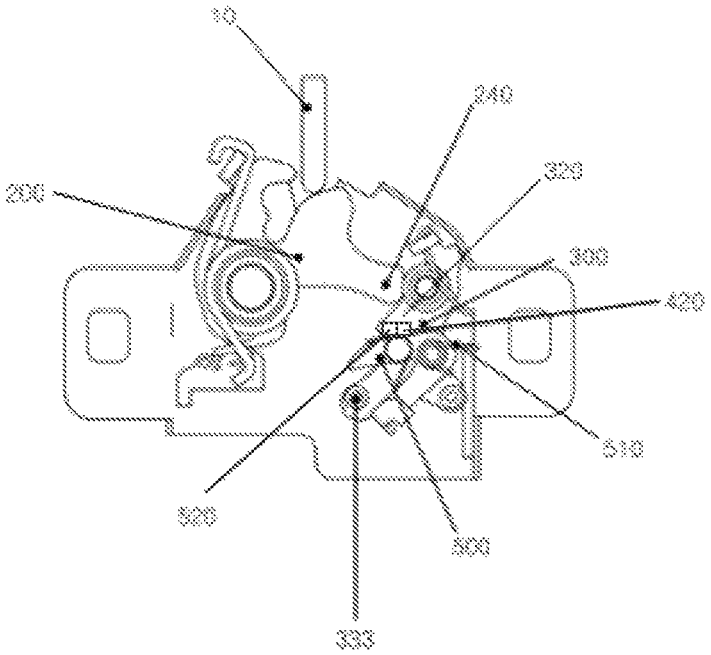

In this state, when the trigger extension link 400 rotates clockwise as shown in FIGS. 2E and 2F, the trigger varying link 500 comes into contact with a side of the first contact projection 333 to rotate counterclockwise, so that it comes into contact with the first contact projection 333 and rotates clockwise. If the trigger extension link 400 rotates counterclockwise again as shown in FIGS. 2G and 2H, the trigger varying link 500 comes into contact with another side of the first contact projection 333, thus rotating the trigger 300 counterclockwise. Here, the third fork protrusion 240 movably comes into contact with the first trigger protrusion 320, thus rotating the fork 200 counterclockwise, and thereby secondarily unlocking the striker 10.

Preferably, a side 501 of the trigger varying link 500 is formed in an arc shape so that it comes into contact with the first contact projection 333 so as to be easily rotated and moved.

Further, as shown in FIGS. 2G and 2H, a trigger contact piece 420 is disposed on an end of the trigger connecting link 400 to come into contact with the first contact projection 333 when the trigger connecting link 400 rotates clockwise again, thus preventing the trigger varying link 500 from being excessively rotated. Preferably, a varying-link contact piece 520 is provided on an end of the trigger varying link 500 to come into contact with the trigger contact piece 420, thus restricting the rotation of the trigger varying link 500.

Further, an elastic member 510 is preferably provided on the trigger varying link 500 to rotate the trigger varying link 500 clockwise, as long as no external force is exerted on the trigger varying link 500. Preferably, an elastic member 410 is preferably provided on the trigger connecting link 400 to rotate the trigger connecting link 400 counterclockwise or clockwise, as long as no external force is exerted on the trigger connecting link 400.

As shown in FIG. 1, a cable coupling groove 433 may be formed in the connecting link extension 430 to apply external force to the connecting link extension 430. Furthermore, an escape slit 110 may be formed in the base 100 to allow a cable (not shown) coupled to the cable coupling groove 433 to be discharged. The escape slit 110 is preferably formed in a slit shape to allow the connecting link extension 430 to be more easily rotated.

Furthermore, the elastic members coupled to the fork 200, the trigger 300, the trigger connecting link 400 and the trigger varying link 500 of the present invention, respectively, may have various shapes. However, in an embodiment of the present invention shown in FIG. 1, each elastic member uses a coil spring that surrounds the rotating shaft of each component. Particularly, the fork 200 and the trigger 300 preferably have a fork spring locking portion 215 and a trigger spring locking portion 315 to which an end of the spring 210 and an end of the spring 310 are locked respectively.

The locked state of the hood latch having the dual unlocking function according to an embodiment of the present invention will be described below with reference to FIGS. 3A to 3E.

Figure 3A:
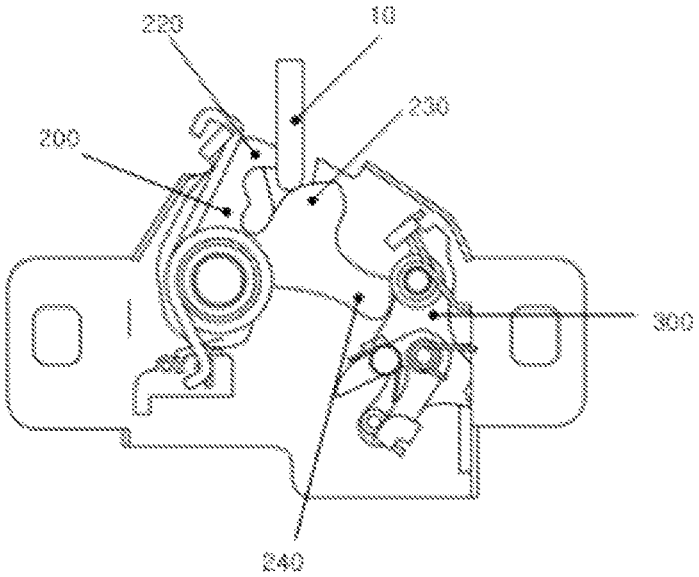
FIGS. 3A to 3E are operational views showing the sequence of locking the striker of the hood latch having the dual unlocking function shown in FIG. 1.
Figure 3B:
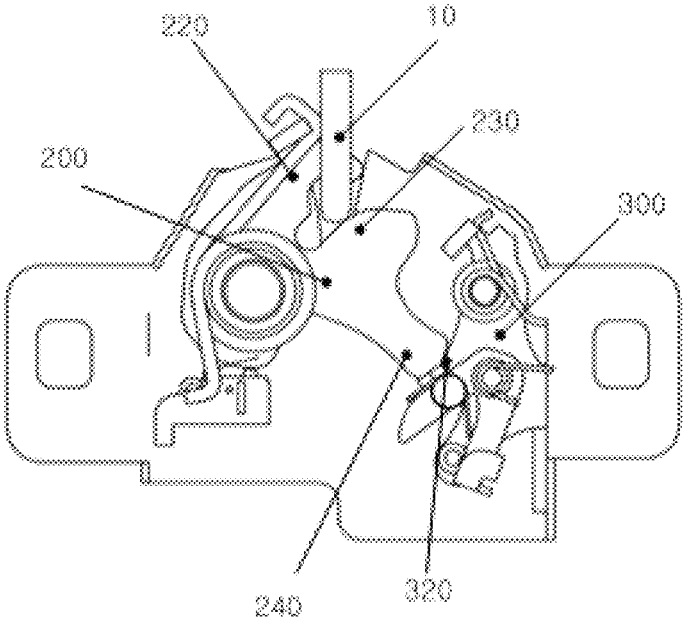

FIG. 3A is a view showing the state in which the striker 10 moves downwards to the hood latch having the dual unlocking function. The striker 10 is inserted between the first fork protrusion 220 and the second fork protrusion 230 of the fork 200 to rotate the fork 200 clockwise. If the fork 200 rotates clockwise, the third fork protrusion 240 of the fork 200 moves clockwise along the first trigger protrusion 320 of the trigger 300 as shown in FIG. 3B, and the trigger 300 rotates counterclockwise.

Figure 3C:
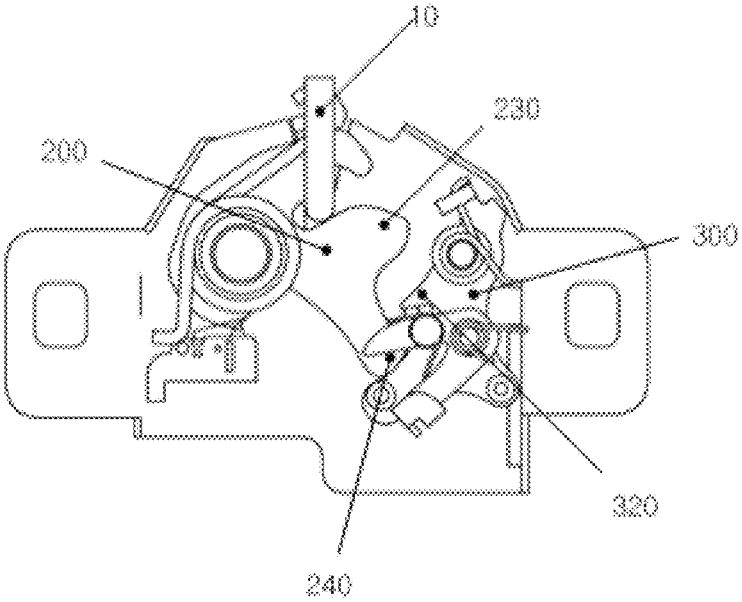
Figure 3D:
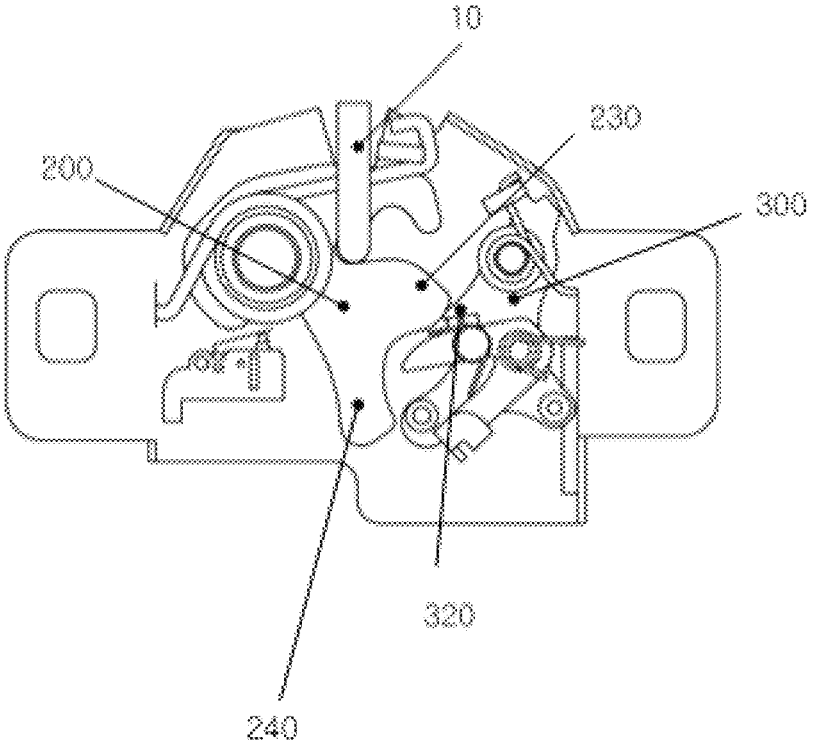
Figure 3E:
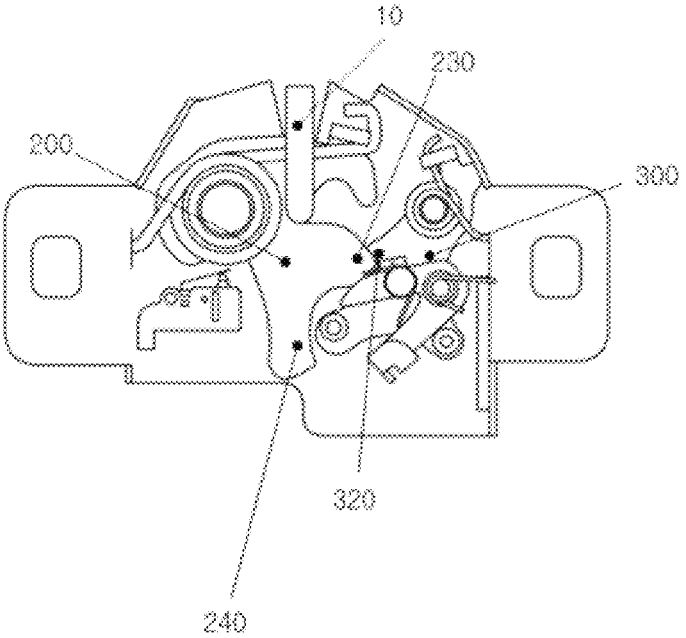

If the fork 200 rotates counterclockwise, as shown in FIG. 3C, the third fork protrusion 240 passes over the first trigger protrusion 320 of the trigger 300 and rotates, thus forming the first locked state. In this state, if the striker 10 rotates further downwards, as shown in FIG. 3D, the second fork protrusion 230 of the fork 200 comes into contact with the first trigger protrusion 320, and passes over the first trigger protrusion 320 as shown in FIG. 3E, thus forming the second locked state.

As described above, the present invention provides a hood latch having a dual unlocking function, which is configured to control the rotating angle of a trigger controlling the rotation of a fork fixing a striker, with the aid of a trigger varying link, thus allowing a hood to be opened only in response to a manipulation in the interior of a vehicle.

The present invention is not limited to the above-mentioned effect, and those skilled in the art can clearly understand other effects that are not mentioned, based on the detailed description.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A hood latch having a dual unlocking function, the hood latch comprising:

a base coupled to a frame or a panel of a vehicle;

a fork rotatably coupled to the base and configured to rotate about a first axis of rotation in a first direction or a second direction opposite the first direction, the fork comprising:

a first fork, protrusion;

a second fork protrusion; and a third fork protrusion, the fork being configured to fix a striker positioned on a vehicle hood;

a trigger configured to rotate in the first direction or the second direction about a second axis of rotation, the trigger comprising:

a first trigger protrusion configured to contact the second fork protrusion or the third fork protrusion based on a rotation of the trigger;

a second trigger protrusion; and a third trigger protrusion;

a trigger connecting link configured to rotate in the first direction or the second direction about a third axis of rotation, the trigger connecting link being configured to contact the third trigger protrusion based on a rotation of the trigger connecting link in the second direction; and a trigger varying link rotatably coupled to a first side of the trigger connecting link, the trigger varying link being configured to rotate in the first direction or the second direction about a fourth axis of rotation, wherein the trigger varying link is configured to contact the second trigger protrusion based on a position of the trigger varying link with respect to the second trigger protrusion at a time when the trigger connecting link is rotated in the first direction or the second direction, and a rotating angle of the trigger is based on a contact between the trigger connecting link and the third trigger protrusion or a contact between the trigger varying link and the second trigger protrusion.

2. The hood latch as set forth in claim 1, wherein the base comprises on a first side thereof a fork rotating shaft, and on a second side thereof a trigger rotating shaft, the first fork protrusion, the second fork protrusion and the third fork protrusion are sequentially formed about the fork rotating shaft, and the first trigger protrusion, the second trigger protrusion and the third trigger protrusion are sequentially positioned about the trigger rotating shaft.

3. The hood latch as set forth in claim 1, further comprising:

a connecting link extension on a second side of the trigger connecting link, wherein the second trigger protrusion comprises a first contact projection, and the third trigger protrusion comprises a second contact projection, the connecting link extension is configured to contact with the second contact projection if the trigger connecting link rotates in the second direction, and to cause the trigger to rotate in the second direction such that the fork is caused to rotate in the second direction at least until the third fork protrusion comes into contact with a first side of the first trigger protrusion, thereby primarily unlocking the striker, a first side of the trigger varying link is configured to contact a first side of the first contact projection if the trigger connecting link rotates in the first direction and the trigger varying link is between the first contact projection and the second contact projection at a time the trigger connecting link begins to rotate in the first direction, the trigger varying link is configured to rotate in the second direction upon contacting the first side of the first contact projection based on the trigger connecting link rotating in the first direction, a second side of the trigger varying link is configured to contact a second side of the first contact projection if the trigger connecting link rotates in the second direction and the first contact projection is between the trigger varying link and the connecting link extension at a time the trigger connecting link begins to rotate in the second direction, and the trigger varying link is configured to cause the trigger to rotate in the second direction, based on the trigger connecting link rotating in the second direction and a contact between the second side of the trigger varying link and the second side of the first contact projection, such that the fork is caused to rotate in the second direction at least until the third fork protrusion comes into contact with a second side of the first trigger protrusion, thereby secondarily unlocking the striker.

4. The hood latch as set forth in claim 3, wherein the first side of the trigger varying link is arc shaped.

5. The hood latch as set forth in claim 4, wherein the second side of the trigger varying link is substantially planar.

6. The hood latch as set forth in claim 3, further comprising:

a trigger contact piece on the first side of the trigger connecting link; and a varying-link contact piece on the first side of the trigger varying link, wherein the varying-link contact piece is configured to contact the trigger contact piece to restrict a rotation of the trigger varying link.

7. The hood latch as set forth in claim 6, further comprising:

a varying-link spring configured to cause the trigger varying link to rotate in the first direction absent a contact between the varying-link contact piece and the trigger contact piece.

8. The hood latch as set forth in claim 1, further comprising:

a fork spring configured to cause the fork to rotate in the second direction absent a contact between the fork and the trigger;

a trigger spring configured to cause the trigger to rotate in the first direction absent a contact between the trigger and the fork; and a trigger connecting link spring configured to cause the trigger connecting link to rotate in the second direction absent a contact between the trigger connecting link and the trigger.

9. The hood latch as set forth in claim 1, wherein the second axis of rotation, the third axis of rotation and the fourth axis of rotation are substantially parallel to the first axis of rotation.

10. The hood latch as set forth in claim 1, wherein the trigger connecting link is substantially v-shaped.

11. The hood latch as set forth in claim 1, where the trigger connecting link is substantially u-shaped.

12. The hood latch as set forth in claim 1, further comprising:

a connecting link extension on a second side of the trigger connecting link, wherein the second trigger protrusion comprises a first contact projection, and the third trigger protrusion comprises a second contact projection, and the connecting link extension is configured to contact the second contact projection if the trigger connecting link rotates in the second direction, and to cause the trigger to rotate in the second direction such that the fork is caused to rotate in the second direction at least until the third fork protrusion comes into contact with the first trigger protrusion, thereby primarily unlocking the striker.

* * * * *